US009341003B2

(12) United States Patent
Ely et al.

(10) Patent No.: US 9,341,003 B2
(45) Date of Patent: May 17, 2016

(54) LATCH FOR STORAGE CASE

(71) Applicant: Ingersoll-Rand Company, Davidson, NC (US)

(72) Inventors: Sean C. Ely, Flemington, NJ (US); Jefferey C. Yaschur, Doylestown, PA (US)

(73) Assignee: Ingersoll-Rand Company, Davidson, NC (US)

( * ) Notice: Subject to any disclaimer, the term of this patent is extended or adjusted under 35 U.S.C. 154(b) by 0 days.

(21) Appl. No.: 14/199,054

(22) Filed: Mar. 6, 2014

(65) Prior Publication Data

US 2014/0251999 A1 Sep. 11, 2014

Related U.S. Application Data

(60) Provisional application No. 61/774,639, filed on Mar. 8, 2013.

(51) Int. Cl.

| | |
|---|---|
| ***E05C 19/00*** | (2006.01) |
| ***E05B 65/52*** | (2006.01) |
| ***E05B 65/50*** | (2006.01) |

(52) U.S. Cl.

CPC ..... *E05B 65/5276* (2013.01); *E05B 65/50* (2013.01); *Y10T 292/20* (2015.04)

(58) Field of Classification Search

CPC ... E05B 65/5276; E05B 65/50; Y10T 292/20; E05C 19/00; E05C 19/08; E05C 19/022; E05C 19/007; E05C 3/041; A45C 13/1084; A45C 13/1067

USPC ..... 220/324; 292/256, 285, DIG. 30, 292/DIG. 41; 70/69, 70, 72, 76

See application file for complete search history.

(56) References Cited

U.S. PATENT DOCUMENTS

| | | | | |
|---|---|---|---|---|
| 3,885,407 | A * | 5/1975 | Feinberg | 70/76 |
| 3,998,077 | A * | 12/1976 | Bako | 70/74 |
| 4,509,622 | A * | 4/1985 | Morszeck | 190/119 |
| 4,679,833 | A * | 7/1987 | Dueringer | 292/113 |
| 5,924,533 | A * | 7/1999 | Cnockaert et al. | 190/18 A |
| 6,032,988 | A * | 3/2000 | Klein | 292/247 |
| 6,547,293 | B1 * | 4/2003 | Cheng | 292/247 |
| D533,434 | S * | 12/2006 | Riblett et al. | D8/331 |
| 8,567,828 | B2 * | 10/2013 | Andren et al. | 292/66 |
| 2006/0042897 | A1 * | 3/2006 | Sanderson | 190/120 |
| 2008/0307835 | A1 * | 12/2008 | Grenier et al. | 70/69 |
| 2008/0308568 | A1 * | 12/2008 | Grenier et al. | 220/810 |

* cited by examiner

*Primary Examiner* — Anthony Stashick
*Assistant Examiner* — Ernesto Grano
(74) *Attorney, Agent, or Firm* — Barnes & Thornburg LLP

(57) ABSTRACT

Illustrative embodiment of latches for storage cases are disclosed. In one illustrative embodiment, a latch may comprise a first component coupled to a first tab extending from a case, where the first component includes a plurality of first engagement sections and each of the plurality of first engagement sections has a first aperture formed therein, a second component including a plurality of second engagement sections, where each of the plurality of second engagement sections has a second aperture formed therein and each of the plurality of first engagement sections is engaged with one of the plurality of second engagement sections such that the first and second apertures are aligned along a common axis, and a hinge pin positioned through the first and second apertures, such that the second component is pivotable about the common axis.

19 Claims, 6 Drawing Sheets

LATCH FOR STORAGE CASE

CROSS REFERENCE TO RELATED APPLICATION

This application claims the benefit of U.S. Provisional Patent Application Ser. No. 61/774,639, filed Mar. 8, 2013, the entire disclosure of which is incorporated by reference herein.

TECHNICAL FIELD

The present disclosure relates, generally, to latches and, more particularly, to latches for storage cases.

BACKGROUND

Storage cases typically include a body and a lid pivotably coupled to the body (e.g., via one or more hinges). The body may at least partially define an interior compartment of the case, and the lid may be movable between an open position permitting access to the interior compartment and a closed position preventing access to the interior compartment. The case may also include one or more latches for selectively securing the lid in the closed position. By way of example, the case may be used for storing and/or carrying a power tool.

SUMMARY

According to one aspect, a latch may comprise a first component coupled to a first tab extending from a case, where the first component includes a plurality of first engagement sections and each of the plurality of first engagement sections has a first aperture formed therein, a second component including a plurality of second engagement sections, where each of the plurality of second engagement sections has a second aperture formed therein and each of the plurality of first engagement sections is engaged with one of the plurality of second engagement sections such that the first and second apertures are aligned along a common axis, and a hinge pin positioned through the first and second apertures, such that the second component is pivotable about the common axis.

In some embodiments, the second component may be configured to releasably couple to a second tab extending from the case. The second component may be configured to have an interference fit with the second tab when releasably coupled to the second tab. The second component may include a detent formed on an interior surface of the second component and configured to be received in a recess formed in an exterior surface of the second tab when the second component is releasably coupled to the second tab. The second component may comprise a cam surface configured to engage the second tab to cause the second component to pivot about the common axis. The first and second components may cooperate to surround the first tab and the second tab when the first and second components are coplanar.

In some embodiments, the first component may have a U-shape with the plurality of first engagement sections being located at ends of the U-shape, and the second component may have a U-shape with the plurality of second engagement sections being located at ends of the U-shape. An interlocking feature may couple the first component to the first tab. The interlocking feature may comprise a protrusion formed on an interior surface of the first component that is received in a recess formed in an exterior surface of the first tab. The hinge pin may be positioned in a groove formed in an exterior surface of the first tab. The hinge pin may be formed of metal.

The latch may further comprise a torsion spring having a first end engaged with the first component and a second end engaged with the second component, such that the torsion spring biases the second component to pivot about the common axis. A central section of the torsion spring between the first and second ends may be wrapped around the hinge pin.

According to another aspect, a case may comprise a body at least partially defining an interior compartment, where the body includes a body tab extending therefrom, a lid pivotably coupled to the body and movable between an open position permitting access to the interior compartment and a closed position preventing access to the interior compartment, where the lid includes a lid tab extending therefrom and the lid tab is positioned adjacent the body tab when the lid is in the closed position, and a latch including an upper component coupled to the lid tab, a lower component configured to releasably couple to the body tab when the lid is in the closed position, and a hinge pin pivotably coupling the lower component to the upper component.

In some embodiments, the lower component may comprise a cam surface configured to engage the body tab as the lid is moved from the open position to the closed position to pivot the lower component. The upper component may include a pair of upper engagement sections, and the lower component includes a pair of lower engagement sections. Each of the pair of lower engagement sections may engage one of the pair of upper engagement sections. The upper component may have a U-shape with the pair of upper engagement sections being located at ends of the U-shape, and the lower component may have a U-shape with the pair of lower engagement sections being located at ends of the U-shape. Each of the pair of upper engagement sections may have an upper aperture formed therein, each of the pair of lower engagement sections may have a lower aperture formed therein, and the hinge pin may be positioned through the upper and lower apertures.

In some embodiments, the lower component may be configured to have an interference fit with the body tab when releasably coupled to the body tab. The lower component may include a detent formed on an interior surface of the lower component and configured to be received in a recess formed in an exterior surface of the body tab when the lower component is releasably coupled to the body tab. The upper and lower components may cooperate to surround the lid tab and the body tab when the lid is in the closed position and the lower component is releasably coupled to the body tab. An interlocking feature may couple the upper component to the lid tab. The interlocking feature may comprise a protrusion formed on the upper component that is received in a recess formed in the lid tab. The hinge pin may be positioned in a groove formed in the lid tab.

In some embodiments, the latch may further include a torsion spring having a first end engaged with the upper component and a second end engaged with the lower component. The torsion spring may bias the lower component of the latch away from the body. In other embodiments, the torsion spring may bias the lower component of the latch toward the body. A central section of the torsion spring between the first and second ends may be wrapped around the hinge pin.

BRIEF DESCRIPTION

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements.

Figure 1:
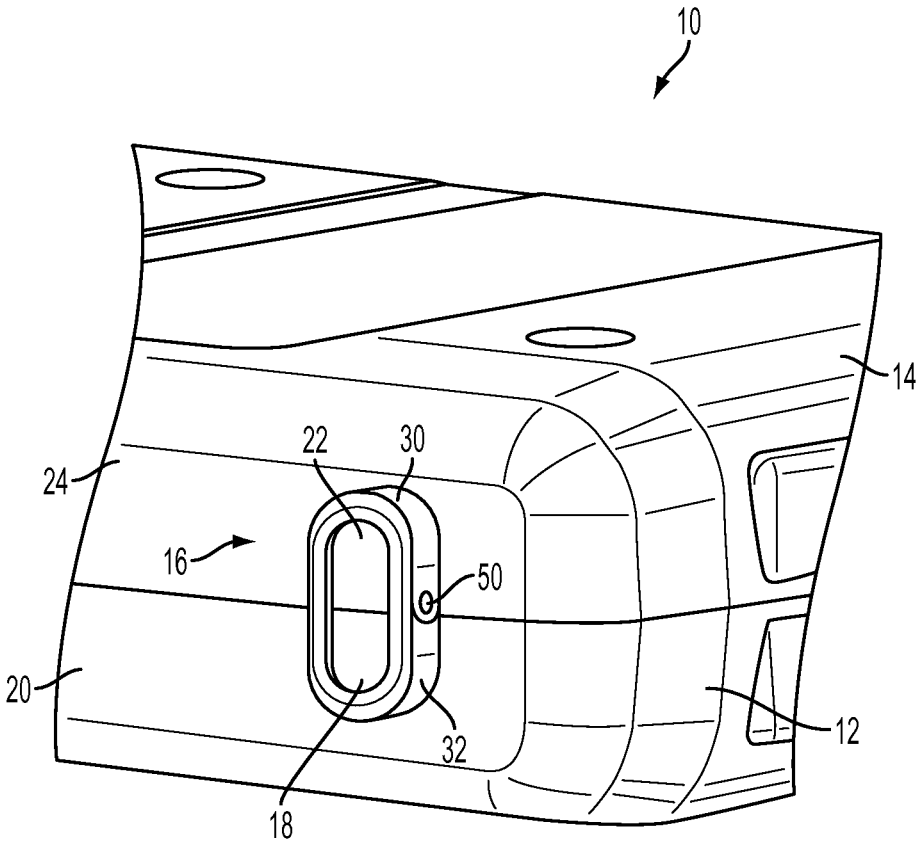
FIG. 1 is a perspective view of a portion of a case that includes a latch to secure a lid of the case in a closed position.
Figure 2:
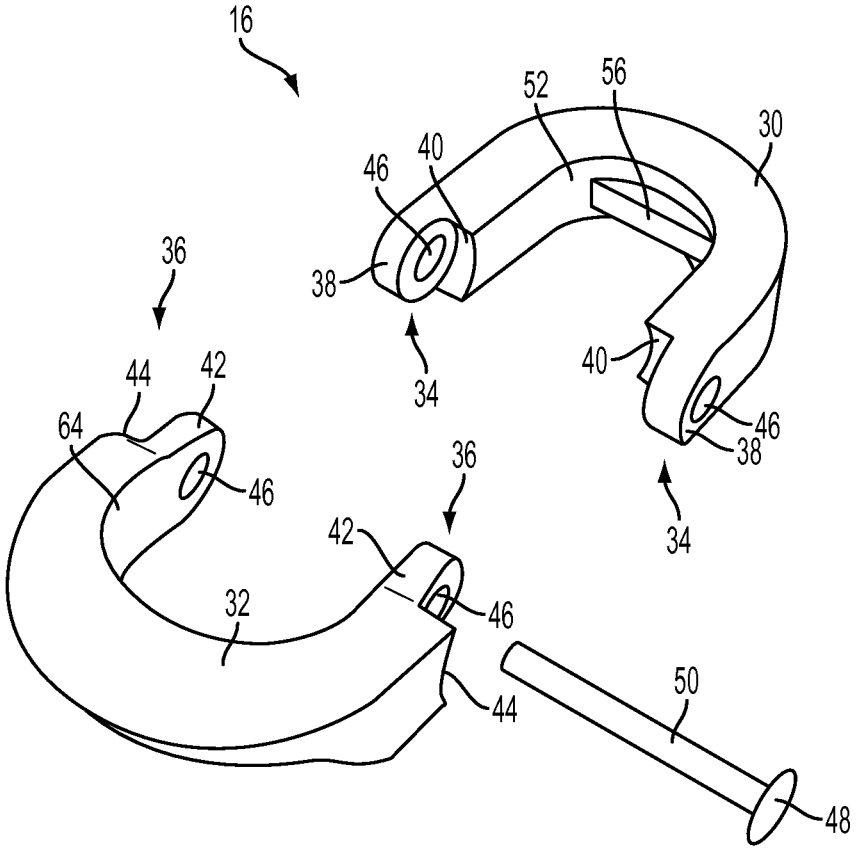
FIG. 2 is an exploded perspective view of an upper component, a lower component, and a hinge pin of the latch of FIG. 1.
Figure 3:
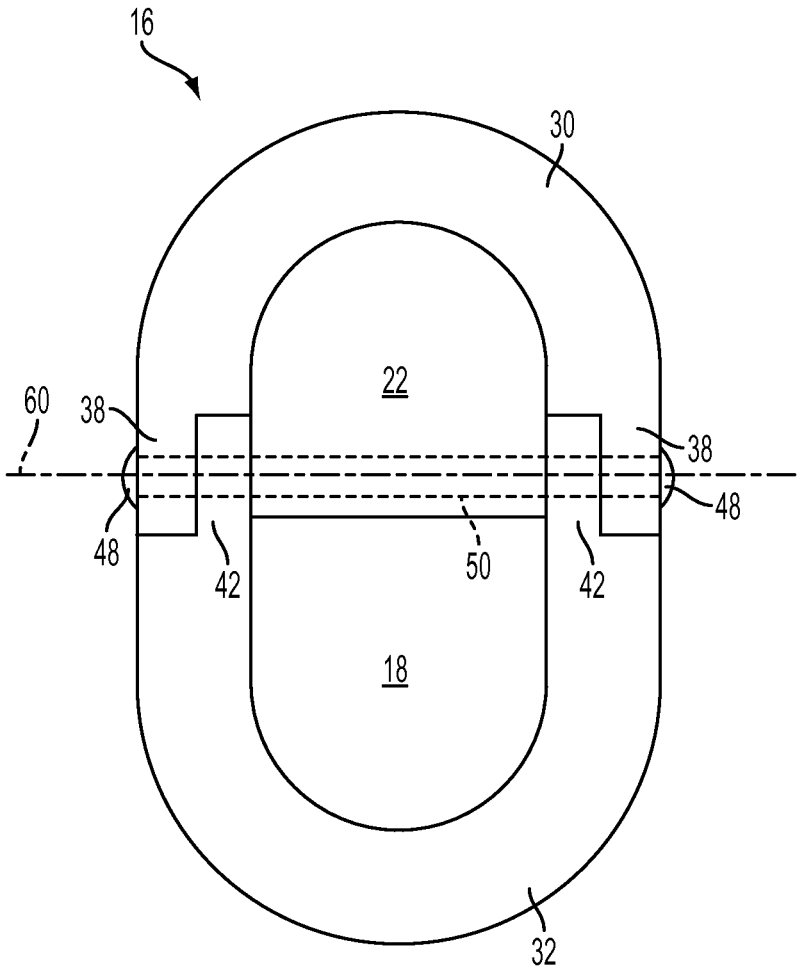
FIG. 3 is a front view of the latch of FIG. 1, with the upper component of the latch coupled to a lid tab of the case and the lower component of the latch releasably coupled to a body tab of the case to secure the lid of the case in the closed position.
Figure 4:
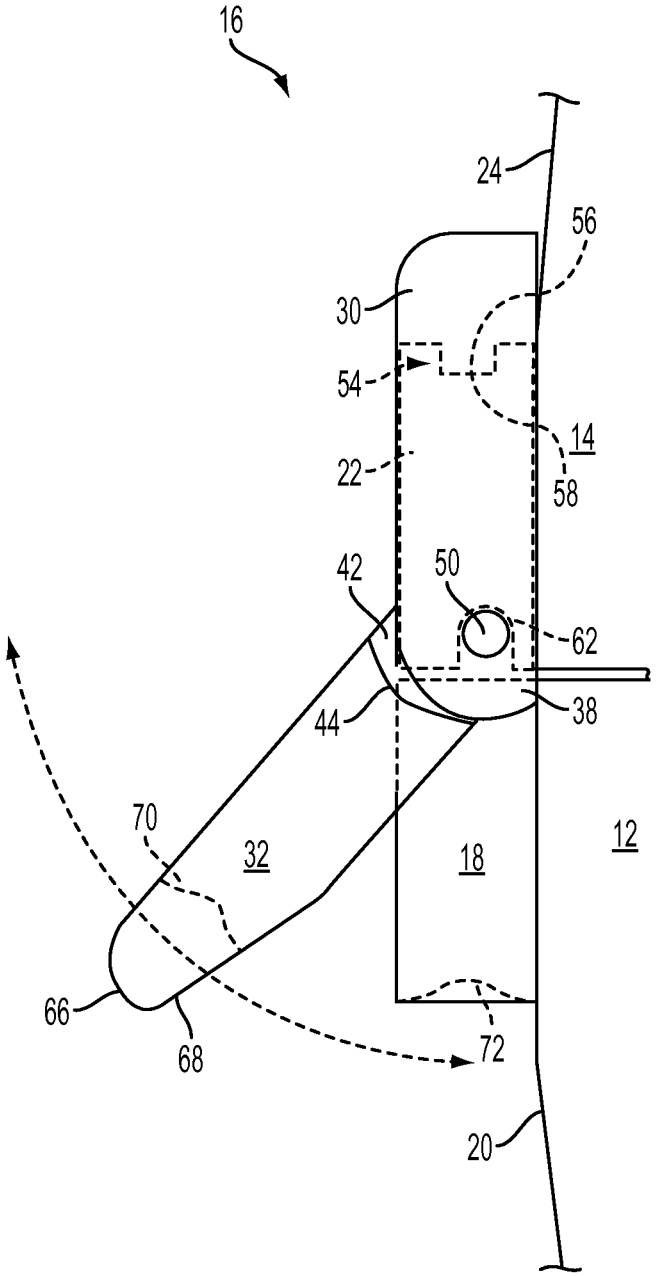
Figure 5:
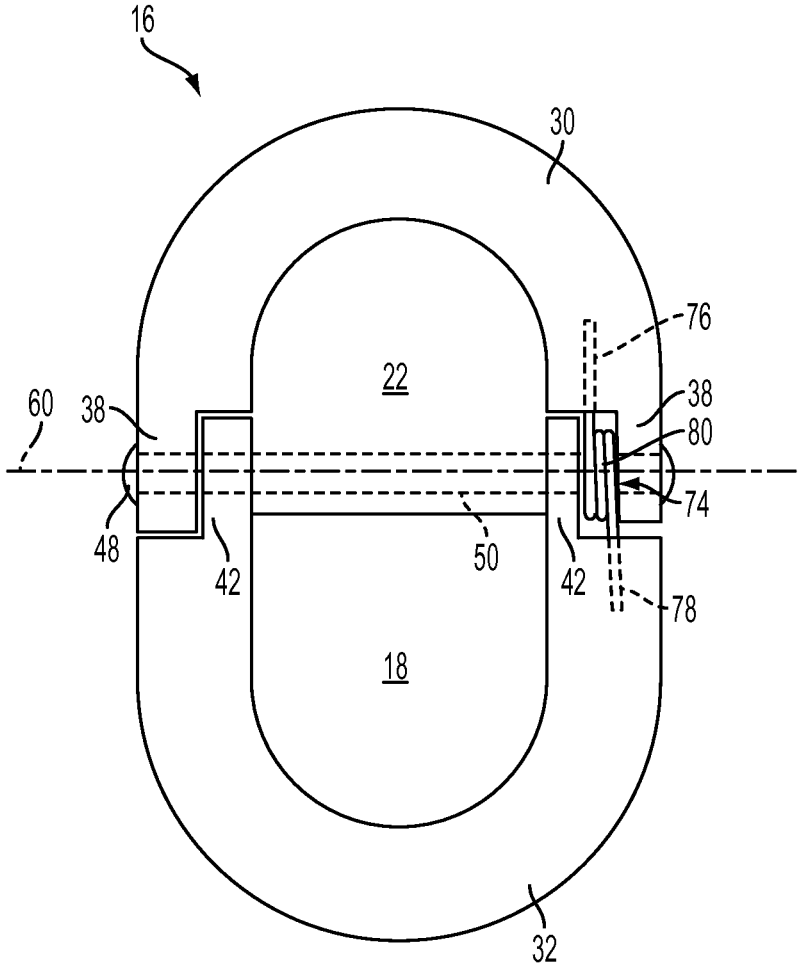

FIG. 4 is a side view of the latch of FIG. 1, with the upper component of the latch coupled to the lid tab of the case and the lower component of the latch uncoupled from the body tab of the case to allow the lid of the case to be moved between the closed position and an open position; and FIG. 5 is a front view of another illustrative embodiment of a latch, similar to the latch of FIGS. 1-4, but including a torsion spring.

Figure 6:
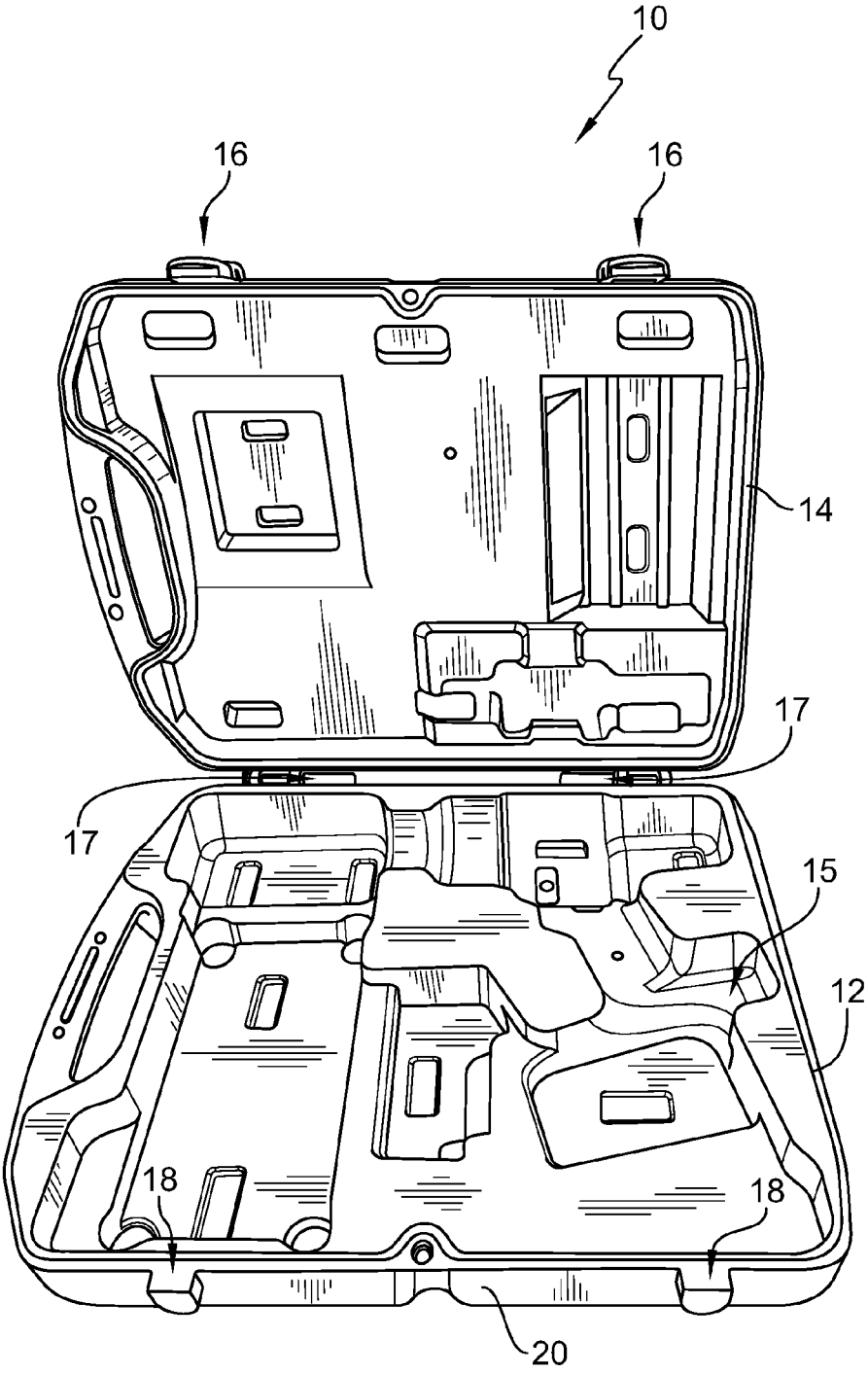

FIG. 6 is a front view of the case of FIG. 1, with the lid in an open position relative to the body.

DETAILED DESCRIPTION

While the concepts of the present disclosure are susceptible to various modifications and alternative forms, specific exemplary embodiments thereof have been shown by way of example in the figures and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

Referring to FIG. 1, a portion of one illustrative embodiment of a storage case 10 is shown. The case 10 may be used to store and/or carry a power tool and associated accessories, including, but not limited to, a cordless electric power tool, a corded electric power tool, or a pneumatic power tool. It will be appreciated that, in other embodiments, the case 10 may be used for any number of other purposes. The case 10 includes a body 12 and a lid 14. In the illustrative embodiment, the body 12 and the lid 14 are each formed of molded plastic (e.g., injection molded plastic or extrusion blow molded (EBM) plastic). In other embodiments, the body 12 and/or the lid 14 may be constructed from other materials (e.g., metal). As shown in FIG. 1, the body 12 and the lid 14 each have a generally rectangular shape in the illustrative embodiment of case 10. While the body 12 and the lid 14 are shown in FIG. 1 as being of similar size and shape, it is contemplated that the body 12 and the lid 14 may have other configurations, in other embodiments. As best seen in FIG. 6, surfaces included in the body 12 partially define an interior compartment 15 of the case 10. Surfaces included in the lid 14 also partially define the interior compartment 15 of the case 10. In the illustrative embodiment, the interior compartment 15 is sized to provide storage space for a power tool and associated accessories.

The lid 14 is pivotably coupled to the body 12 through a number of hinges 17 as shown in FIG. 6. As such, the lid 14 is movable relative to the body 12 between a closed position and an open position. As shown in FIG. 1, the lid 14 is in the closed position, in which the lid 14 engages the body 12. In this closed position, the surfaces included in the lid 14 cooperate with the surfaces included in the body 12 to enclose the interior compartment 15 of the case 10. As such, access to any items stored in the interior compartment 15 is prevented when the lid 14 is in the closed position shown in FIG. 1. When the lid 14 is in the open position shown in FIG. 6, the interior compartment 15 of the case 10 (and any items stored therein) will be accessible. The lid 14 may be moved between the closed position and the open position by pivoting the lid 14 on the hinges 17.

As described in more detail below, the case 10 also includes at least one latch 16 that is operable to secure the lid 14 of the case 10 in the closed position shown in FIG. 1 (i.e., to secure the lid 14 in engagement with the body 12 to enclose the interior compartment 15 of the case 10). While only one latch 16 is shown in FIG. 1, it is contemplated that the case 10 may include any number of latches 16. In the illustrative embodiment, as best seen in FIG. 6, the at least one latch 16 is positioned on a side of the case 10 opposite the hinges 17 that pivotably couple the lid 14 to the body 12. Additionally or alternatively, one or more latches 16 may be positioned on other sides of the case 10, in other embodiments.

The case 10 includes at least one body tab 18 extending from the body 12. While only one body tab 18 is shown in FIG. 1, it is contemplated that the case 10 may include any number of body tabs 18 (and will generally include the same number of body tabs 18 as latches 16). In the illustrative embodiment, the body tab 18 comprises molded plastic and is integrally formed with the body 12. It is contemplated that, in other embodiments, the body tab 18 may be formed of other materials and/or as a distinct component from the body 12. In the illustrative embodiment of FIG. 1, the body tab 18 is formed on a front surface 20 of the body 12 and extends outwardly from the front surface 20.

The case 10 also includes at least one lid tab 22 extending from the lid 14, as shown in FIG. 1. While only one lid tab 22 is shown in FIG. 1, it is contemplated that the case 10 may include any number of lid tabs 22 (and will generally include the same number of lid tabs 22 as latches 16). In the illustrative embodiment, the lid tab 22 comprises molded plastic and is integrally formed with the lid 14. It is contemplated that, in other embodiments, the lid tab 22 may be formed of other materials and/or as a distinct component from the lid 14. In the illustrative embodiment of FIG. 1, the lid tab 22 is formed on a front surface 24 of the body 12 and extends outwardly from the front surface 24. When the lid 14 is in the closed position shown in FIG. 1, the lid tab 22 is positioned adjacent the body tab 18.

As best seen in FIG. 2, the latch 16 includes an upper component 30 and a lower component 32. In the illustrative embodiment, the upper and lower components 30, 32 are each formed of molded plastic (e.g., injection molded plastic or EBM plastic). In other embodiments, the upper component 30 and/or the lower component 32 may be constructed from other materials (e.g., metal). In the illustrative embodiment, the upper and lower components 30, 32 each generally have a U-shape and are of similar size. It is contemplated that, in other embodiments, the upper and lower components 30, 32 may have different configurations. As described in more detail below, when the latch 16 is assembled, the upper component 30 is coupled to the lid tab 22, while the lower component 32 is configured to releasably couple to the body tab 18.

In the illustrative embodiment, the upper component 30 includes a pair of upper engagement sections 34, and the lower component 32 includes a pair of lower engagement sections 36. As shown in FIG. 2, the engagement sections 34, 36 are located at respective ends of the U-shapes of the upper and lower components 30, 32. It is contemplated that, in other embodiments, the upper and lower components 30, 32 may include any number of respective engagement sections 34, 36. Each of the upper engagement sections 34 is configured to engage one of the lower engagement sections 36 when the latch 16 is assembled.

Each of the upper engagement sections 34 includes a protruding portion 38 and a receiving portion 40. Each of the lower engagement sections 36 also includes a protruding portion 42 and a receiving portion 44. Each protruding portion 38 of each upper engagement section 34 is configured to be received in the receiving portion 44 of the corresponding lower engagement section 36. Similarly, each protruding portion 42 of each lower engagement section 36 is configured to be received in the receiving portion 40 of the corresponding upper engagement section 34. In the illustrative embodiment, the protruding portions 38 of the upper engagement sections 34 and the receiving portions 44 of the lower engagement sections 36 are laterally located, while the receiving portions 40 of the upper engagement sections 34 and the protruding portions 42 of the lower engagement sections 36 are medially located. It is contemplated that, in other embodiments, the upper and lower engagement sections 34, 36 may have other configurations (including an opposite configuration of the protruding portions 38, 42 and the receiving portions 40, 44). Each of the protruding portions 38, 42 (of the upper and lower engagement sections 34, 36) has an aperture 46 formed therein.

As best seen in FIG. 2, the latch 16 also includes a hinge pin 50. In the illustrative embodiment, the hinge pin 50 is formed of metal. In other embodiments, the hinge pin 50 may comprise other materials (e.g., plastic). When the latch is assembled (as shown in FIGS. 1, 3, and 4), the hinge pin 50 is positioned in the apertures 46 formed in the protruding portions 38, 42 of the upper and lower engagement sections 34, 36. The hinge pin 50 pivotably couples the lower component 32 to the upper component 30, such that the lower component may pivot relative to the upper component 30. The hinge pin 50 may comprise any number of mechanical fasteners, including, but not limited to, one or more bolts, rivets, dowels, or pegs. The hinge pin 50 may include a head 48 at one or both ends to prevent movement of the hinge pin 50 once the latch 16 is assembled.

Referring now to FIGS. 3 and 4, the latch 16 is assembled on the case 10 by first engaging the upper component 30 with the lid tab 22. More particularly, an interior surface 52 of the upper component 30 (in the illustrative embodiment, the inside of the U-shape) is brought into engagement with an exterior surface of the lid tab 22. As shown in FIG. 3, the upper component 30 surrounds the exterior surface of the lid tab 22 except for a portion of the exterior surface that faces the body tab 18. In the illustrative embodiment, the upper component 30 and the lid tab 22 together include an interlocking feature 54 that couples the upper component 30 to the lid tab 22. The interlocking feature 54 includes a protrusion 56 formed on the interior surface 52 of the upper component 30 and a recess 58 formed in the exterior surface of the lid tab 22. As the interior surface 52 of the upper component 30 is brought into engagement with the exterior surface of the lid tab 22, the protrusion 56 is received in the recess 58. This interlocking feature 54 prevents (or at least impedes) movement of the upper component 30 away from the front surface 24 of the lid 14 once the upper component 30 is engaged with the lid tab 22, thereby coupling the upper component 30 to the lid tab 22. It is contemplated that, in other embodiments, the interlocking feature 54 may have any number of other configurations.

Assembly of the latch 16 continues by next engaging the lower engagement sections 36 of the lower component 32 with the upper engagement sections 34 of the upper component 30. In the illustrative embodiment, the protruding portion 38 of each upper engagement section 34 is received in the receiving portion 44 of the corresponding lower engagement section 36, while the protruding portion 42 of each lower engagement section 36 is received in the receiving portion 40 of the corresponding upper engagement section 34. This results in alignment of the apertures 46 formed in the protruding portions 38, 42 (of the upper and lower engagement sections 34, 36) along a common axis 60, as shown in FIG. 3.

Assembly of the latch 16 concludes by positioning the hinge pin 50 through the apertures 46, such that the hinge pin 50 also lies along the common axis 60 (as shown in phantom in FIG. 3). As shown in FIG. 4, the lid tab 22 of the illustrative embodiment also includes a groove 62 formed in its exterior surface (in particular, the portion of the exterior surface that faces the body tab 18). This groove 62 receives the hinge pin 50 when the hinge pin 50 is positioned through the apertures 46. Like the interlocking feature 54, the interaction of the hinge pin 50 and the groove 62 prevents (or at least impedes) movement of the upper component 30 away from the front surface 24 of the lid 14, thereby coupling the upper component 30 to the lid tab 22.

Once the latch 16 is assembled, the lower component 32 is pivotable relative to the upper component 30. As such, when the lid 14 is in the closed position and the lid tab 22 is positioned adjacent the body tab 18, the lower component 32 may pivot toward the front surface 20 of the body 12 (as indicated in FIG. 4) to releasably couple to the body tab 18 (as shown in FIGS. 1 and 3), thereby securing the lid 14 in the closed position. More particularly, an interior surface 64 of the lower component 32 (in the illustrative embodiment, the inside of the U-shape) may be brought into engagement with an exterior surface of the body tab 18. In the illustrative embodiment, the lower component 32 has an interference fit with the body tab 18 when engaged with the body tab 18. In some embodiments, the lower component 32 and body tab 18 may also releasably couple to the body tab 18 with the aid of a detent 70. In such embodiments, the detent 70 may be formed on the interior surface 64 of the lower component 32, and a recess 72 may be formed in an exterior surface of the body tab 18 (e.g., the portion of the exterior surface that faces away from the lid tab 22), as shown in phantom in FIG. 4. When the lower component 32 is releasably coupled to the body tab 18, the detent 70 will be received in the recess 72, further impeding movement of the lower component 32 away from the front surface 20 of the body 12.

As shown in FIGS. 1 and 3, when the lower component 32 engages the body tab 18, the upper and lower components 30, 32 of the latch 16 are coplanar and cooperate to surround the body and lid tabs 18, 22. When access to the interior compartment 15 of the case 10 is desired, the lower component 32 may pivot away from the front surface 20 of the body 12 (as indicated in FIG. 4) until the interference fit between the lower component 32 and the body tab 18 is released. When the lower component 32 of the latch 16 is in this position, shown in FIG. 4, the lid 14 may be moved between the closed position to the open position.

In some instances, when the lid 14 is moved from the open position to the closed position, a surface 66 of the lower component 32 may interfere with the body tab 18 of the body 12, preventing the lid 14 from closing fully against the body 12 and preventing the latch 16 from securing the lid 14. In these instances, the lower component 32 must be pivoted away from the front surface 20 of the body 12 to avoid interference with the body tab 18 as the lid 14 is moved to the closed position. In the illustrative embodiment, the lower component 32 includes an angled cam surface 68 to improve ease of use. When the lid 14 is moved from the open position to the closed position while the lower component 32 is pivoted inward, the cam surface 68 will contact the body tab 18 and cause the lower component 32 to pivot away from the front surface 20 of the body 12. As such, the cam surface 68 allows the lid 14 to be moved to the closed position without the need to manually pivot the lower component 32 to avoid interference with the body tab 18. In addition to guiding the lower component 32 past the body tab 18 as the lid 14 is closed, the cam surface 68 also provides a convenient grip surface for opening the latch 16. The cam surface 68 may be provided with a generous radius to improve ergonomics.

Referring now to FIG. 5, another illustrative embodiment of the latch 16, including a torsion spring 74, is shown. Except as discussed below, the components of the latch 16 of FIG. 5 may have a similar configuration and operation to the components of the latch 16 of FIGS. 1-4 described above. In the illustrative embodiment shown in FIG. 5, the torsion spring 74 has an upper end 76 that engages the upper component 30 of the latch 16 and a lower end 78 that engages the lower component 32 of the latch 16. By way of example, the upper and lower ends 76, 78 of the torsion spring 74 may be received in respective recesses or voids formed in the upper and lower components 30, 32. As shown in FIG. 5, the torsion spring 74 is illustratively embodied as a resilient metallic wire having a central section 80 (between the ends 76, 78) that is wrapped around the hinge pin 50. As the torsion spring 74 attempts to unwind (due to its resilient nature), the torsion spring 74 exerts a biasing force that attempts to pivot the lower component 32 about the common axis 60.

In the illustrative embodiment of FIG. 5, the torsion spring 74 is configured to bias the lower component 32 of the latch 16 away from the body 12 of the case 10. In other words, the torsion spring 74 attempts to pivot the lower component 32 about the common axis 60 away from the front surface 20 of the body 12 (e.g., toward the position shown in FIG. 4). As such, the torsion spring 74 may help to avoid interference between the lower component 32 and the body tab 18 as the lid 14 is moved from the open position to the closed position. It is also contemplated that, in other embodiments, the torsion spring 74 may instead be configured to bias the lower component 32 of the latch 16 toward the body 12 of the case 10. In other words, the torsion spring 74 may be wound around the hinge pin 50 in an opposite direction, such that the torsion spring 74 attempts to pivot the lower component 32 about the common axis 60 toward the front surface 20 of the body 12 (e.g., toward the position shown in FIGS. 1 and 5). In such embodiments, the torsion spring 74 may help secure the lower component 32 to the body tab 18 when the lid 14 is in the closed position.

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. A latch on a case, the latch comprising:

a first component coupled to a first tab extending from the case, the first component having a U-shape including a plurality of first engagement sections located at ends of the U-shape, each of the plurality of first engagement sections having a first aperture formed therein;

a second component configured to releasably couple to a second tab extending from the case, the second component having a U-shape including a plurality of second engagement sections located at ends of the U-shape, each of the plurality of second engagement sections having a second aperture formed therein, each of the plurality of first engagement sections being engaged with one of the plurality of second engagement sections such that the first and second apertures are aligned along a common axis; and a hinge pin positioned through the first and second apertures, such that the second component is pivotable about the common axis, wherein the first and second components cooperate to surround the first tab and the second tab when the first and second components are coplanar.

2. The latch of claim 1, wherein the second component is configured to have an interference fit with the second tab when releasably coupled to the second tab.

3. The latch of claim 1, wherein the second component comprises a cam surface configured to engage the second tab to cause the second component to pivot about the common axis.

4. The latch of claim 1, wherein an interlocking feature couples the first component to the first tab.

5. The latch of claim 4, wherein the interlocking feature comprises a protrusion formed on an interior surface of the first component that is received in a recess formed in an exterior surface of the first tab.

6. The latch of claim 1, wherein the hinge pin is positioned in a groove formed in an exterior surface of the first tab.

7. The latch of claim 1, wherein the hinge pin is formed of metal.

8. A case comprising:

a body at least partially defining an interior compartment, the body including a body tab extending therefrom;

a lid pivotably coupled to the body and movable between an open position permitting access to the interior compartment and a closed position preventing access to the interior compartment, the lid including a lid tab extending therefrom, the lid tab being positioned adjacent the body tab when the lid is in the closed position; and a latch including (i) an upper component coupled to the lid tab, the upper component having a U-shape with a pair of upper engagement sections located at ends of the U-shape, (ii) a lower component configured to releasably couple to the body tab when the lid is in the closed position, the lower component having a U-shape with a pair of lower engagement sections located at ends of the U-shape, each of the pair of lower engagement sections engaging one of the pair of upper engagement sections, and (iii) a hinge pin pivotably coupling the lower component to the upper component.

9. The case of claim 8, wherein the lower component comprises a cam surface configured to engage the body tab as the lid is moved from the open position to the closed position to pivot the lower component.

10. The case of claim 8, wherein:

each of the pair of upper engagement sections has an upper aperture formed therein; and each of the pair of lower engagement sections has a lower aperture formed therein, the hinge pin being positioned through the upper and lower apertures.

11. The case of claim 8, wherein the lower component is configured to have an interference fit with the body tab when releasably coupled to the body tab.

12. The case of claim 8, wherein the upper and lower components cooperate to surround the lid tab and the body tab when the lid is in the closed position and the lower component is releasably coupled to the body tab.

13. The case of claim 8, wherein an interlocking feature couples the upper component to the lid tab.

14. The case of claim 13, wherein the interlocking feature comprises a protrusion formed on the upper component that is received in a recess formed in the lid tab.

15. The case of claim 8, wherein the hinge pin is positioned in a groove formed in the lid tab.

16. A latch on a case, the latch comprising:

a first component coupled to a first tab extending from the case, the first component including a plurality of first engagement sections, each of the plurality of first engagement sections having a first aperture formed therein;

a second component including a plurality of second engagement sections, each of the plurality of second engagement sections having a second aperture formed therein, each of the plurality of first engagement sections being engaged with one of the plurality of second engagement sections such that the first and second apertures are aligned along a common axis; and a hinge pin positioned through the first and second apertures such that the second component is pivotable about the common axis, wherein (i) the case includes a body that defines an interior compartment and a lid pivotably coupled to the body to move between an open position permitting access to the interior compartment and a closed position preventing access to the interior compartment and (ii) the hinge pin is received in a groove formed in an exterior surface of the first tab both when the lid is in the open position and when the lid is in the closed position.

17. The latch of claim 16, wherein the second component is configured to releasably couple to a second tab extending from the case.

18. The latch of claim 17, wherein the second component comprises a cam surface configured to engage the second tab to cause the second component to pivot about the common axis.

19. The latch of claim 16, wherein the first component includes a protrusion formed on an interior surface thereof, the protrusion being received in a recess formed in the exterior surface of the first tab.

* * * * *